US005700203A

United States Patent [19]

Shieh

[11] Patent Number: 5,700,203

[45] Date of Patent: Dec. 23, 1997

[54] GOLF TRAINING DEVICE

[76] Inventor: Frank Shieh, 1F, No. 19, SzuWei Street, ChuNan, MiaoLi Hsien, Taiwan

[21] Appl. No.: 761,524

[22] Filed: Dec. 6, 1996

[51] Int. Cl.[6] ..... A63B 69/36

[52] U.S. Cl. ..... 473/139; 273/331; 473/147

[58] Field of Search ..... 434/252; 473/139, 473/140, 141, 143, 147; 273/329, 331, 335, 188 C, 185 D

[56] References Cited

U.S. PATENT DOCUMENTS

| | | | |
|---|---|---|---|
| 1,603,094 | 10/1926 | Owens | 473/143 |
| 3,827,696 | 8/1974 | Schafer | 473/147 |
| 3,837,654 | 9/1974 | Hall | 473/143 |
| 3,851,886 | 12/1974 | Acosta | 473/139 |
| 4,932,660 | 6/1990 | Wang | 473/143 |
| 5,035,424 | 7/1991 | Liao | 473/139 |
| 5,121,923 | 6/1992 | Allura | 473/140 |
| 5,255,920 | 10/1993 | Mangeri | 473/143 |
| 5,480,141 | 1/1996 | Wood | 473/140 |

*Primary Examiner*—Paul J. Hirsch

[57] ABSTRACT

A golf training device includes base pad on which an anchoring base is fixed. The anchoring base has a primary column and a secondary column extending upright therefrom and each defining therein a bore. An L-shaped support has a first section movably received within the bore of the primary column and a second section extending transversely from the first section to define a cantilever. A secondary support bar extends from the second section of the L-shaped support to be movably received within the bore of the secondary column. A dummy ball assembly includes a spherical member and two suspension rods having lower ends connected to and extending from the spherical member in a diverging manner to upper ends to define a V shape. A tubular member connects between the upper ends of the suspension rods. The tubular member has a central bore to slidably fit onto the second section of the L-shaped support so as to rotatably suspend the spherical member under the second section of the support and to allow relative moment of the dummy ball assembly with respect to the support by means of bearing. A helical spring is fit onto the second section and located between each of the suspension rods and a fixed portion of the second section in an un-loaded condition for counteracting a component of an external force applied thereon along a direction parallel with the second section.

11 Claims, 4 Drawing Sheets

GOLF TRAINING DEVICE

FIELD OF THE INVENTION

The present invention relates generally to a golf training device and in particular to a vertical suspension type golf training device having shock absorption device.

BACKGROUND OF THE INVENTION

Golf training devices are known, which have a dummy golf ball attached to a fixed point and movable relative thereto on a predetermined plane when hit. Restoring means, such as spring, is provided to move the dummy ball back to its original position for next hit. There are in general two types of golf training device of which one has a substantially horizontal moving plane of the dummy ball, while the other has a substantially vertical moving plane.

The "horizontal moving plane" type of golf training device usually comprises a spring attached to the dummy ball to serve as the restoring means. The spring causes a "drag" on the dummy ball when the dummy ball is hit. This is not a real sensation of really hitting a golf ball, for in hitting a real golf ball, there is no spring drag.

The "vertical moving plane" type usually comprises a suspension to hang the dummy ball freely in the vertical. When the dummy ball is hit, it moves like a pendulum. The gravity that acts on the dummy ball serves as the restoring means to bring the dummy ball back to its original free suspended position. In this way, the spring drag of the "horizontal moving plane" type is eliminated. The suspension that is used in the "vertical moving plane" type has two kinds, of which one is flexible, such as a rope or a wire, and the other is rigid, such as a rigid bar or rod. A support is provided, to which the suspension, both flexible and rigid, is attached. The support is usually in the cantilever form having a free end to support the suspension.

The flexible suspension of the "vertical moving plane" type golf training device has a major disadvantage of wrapping around the golf club if the dummy ball is not properly hit.

Conventionally, the rigid suspension comprises a single rod having an upper end connected to the free end of the L-shaped support by means of for example a universal joint and a lower end to which the dummy ball is fixed. The universal joint allows the dummy ball and the rigid rod to rotate at any directions when hit and thus imposes the least constraint to the movement of the dummy ball. A disadvantage associated with the conventional rigid suspension of the golf training device is that the universal joint and the rod itself are both easy to be damaged during hitting the dummy ball. For example, the rod may be broken if it is mistakenly hit.

It is thus desirable to provide an improvement of the rigid suspension of the "vertical moving plane" type golf training device which overcomes the problem encountered in the conventional rigid suspension of the "vertical moving plane" type golf training device.

SUMMARY OF THE INVENTION

An object of the present invention is to provide a golf training device of the "vertical moving plane" or "vertical suspension" type which comprises an improved suspension to overcome the problem encountered in the prior art rigid suspension of the same type of golf training device.

It is another object of the present invention to provide a golf training device comprising a rigid suspension which comprises two suspension rods arranged in the form of a V shape, with a transverse reinforcing bar extending therebetween to provide a stronger rigid suspension which is not likely to be broken by being mistakenly hit.

It is a further object of the present invention to provide a golf training device of the "vertical moving plane" type wherein bearing and spring device is used to replace the universal joint that is conventionally used so as to increase the mechanical durability against mistakenly hitting force.

In accordance with the present invention, there is provided a golf training device comprising a base pad on which an anchoring base is fixed. The anchoring base has a primary column and a secondary column extending upright therefrom and each defining therein a bore. An L-shaped support has a first section movably received within the bore of the primary column and a second section extending transversely from the first section to define a cantilever. A secondary support bar extends from the second section of the L-shaped support to be movably received within the bore of the secondary column. A dummy ball assembly comprises a spherical member and two suspension rods having lower ends connected to and extending from the spherical member in a diverging manner to upper ends to define a V shape. A tubular member connects between the upper ends of the suspension rods. The tubular member has a central bore to slidably fit onto the second section of the L-shaped support so as to rotatably suspend the spherical member under the second section of the support and to allow relative moment of the dummy ball assembly with respect to the support by means of bearing. A helical spring is fit onto the second section and located between each of the suspension rods and a fixed portion of the second section in an un-loaded condition for counteracting any component of an external force applied thereon along a direction parallel with the second section.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
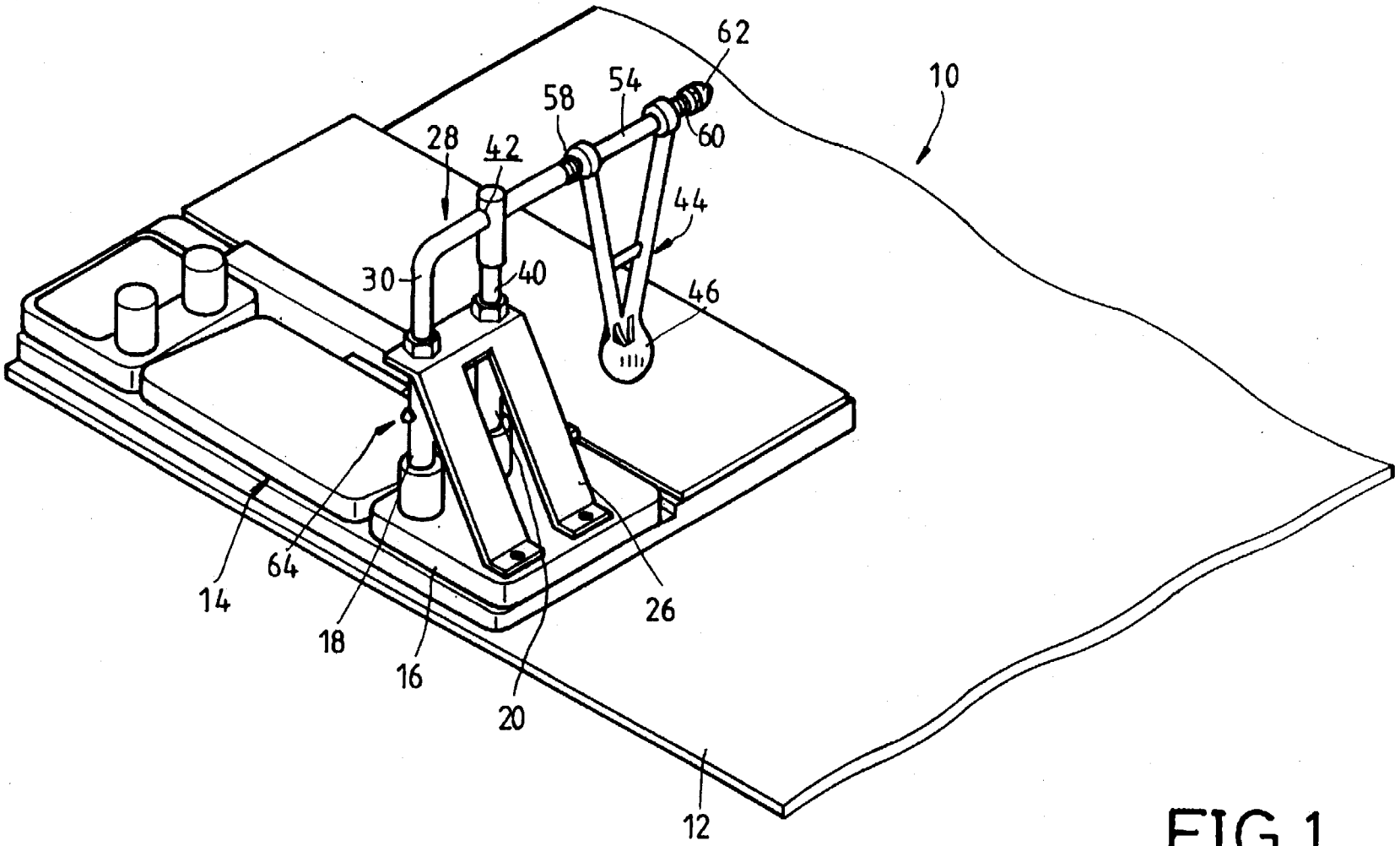
FIG. 1 is a perspective view showing a golf training device in accordance with the present invention.
Figure 2:
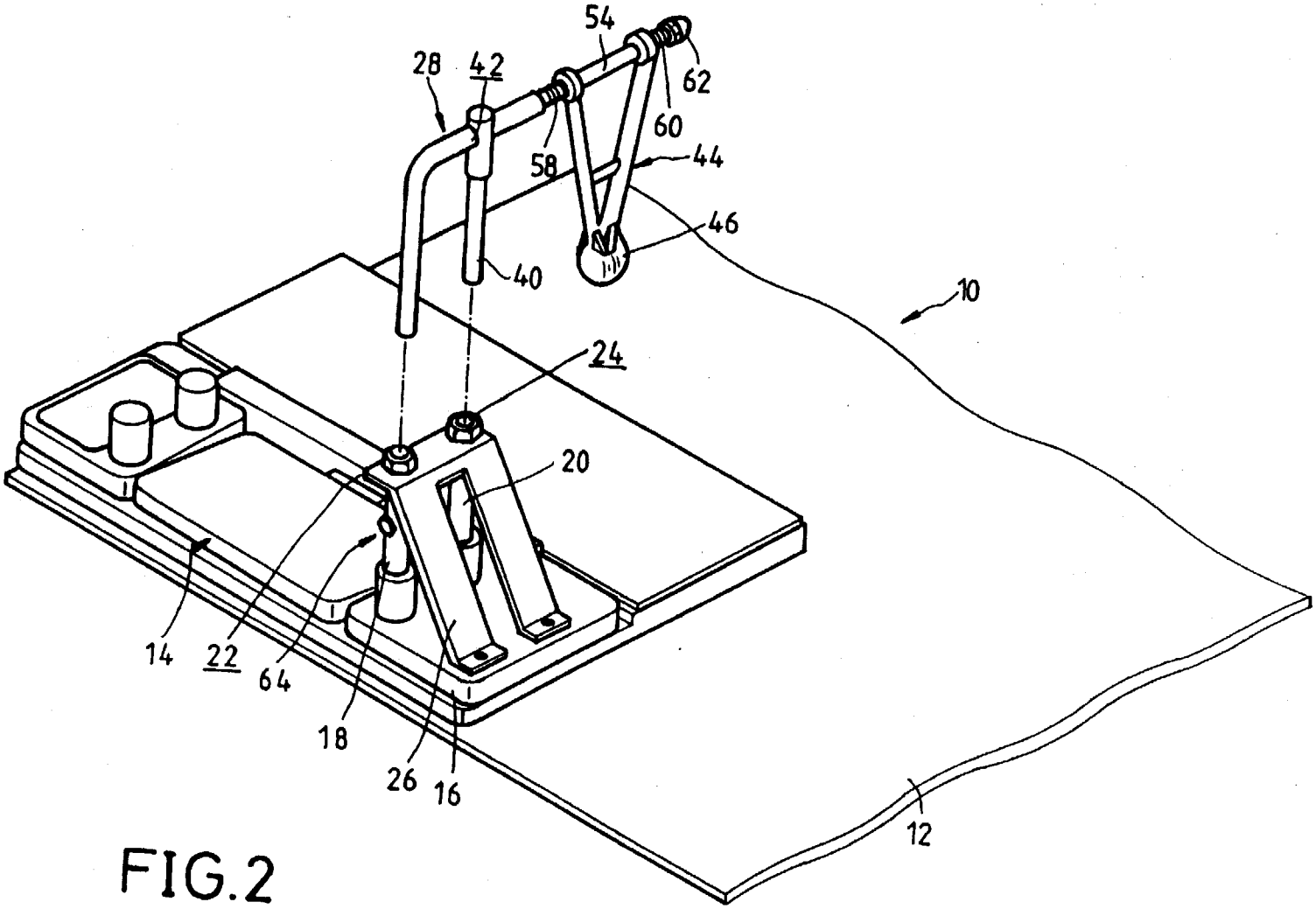
FIG. 2 is an exploded perspective view of the golf training device in accordance with the present invention.

With reference to the drawings and in particular to FIGS. 1 and 2, wherein a golf training device constructed in accordance with the present invention, generally designated with reference 10, is shown, the golf training device 10 comprises a base pad 12 on which a player of the golf training device 10 may stand. Electronic device and display 14 is provided on the base pad 12 to receive and process data detected by sensors incorporated in the golf training device 10 and display information to the player. The electronic device and display 14 may be any known structure and constitutes no part of the present invention so that no detail will be given herein.

The golf training device 10 of the present invention comprises an anchoring base 16 fixed on the base pad 12.

The anchoring base 16 comprises a primary column 18 and a secondary column 20 extending upright therefrom. Each of the columns 18 and 20 are tubular members of a predetermined height, defining therein a vertical bore 22 or 24.

Braces 26 may be provided to extend in an inclined direction from upper ends of the columns 18 and 20 to the anchoring base 16 to more securely hold the columns 18 and 20 in position.

Figure 3:
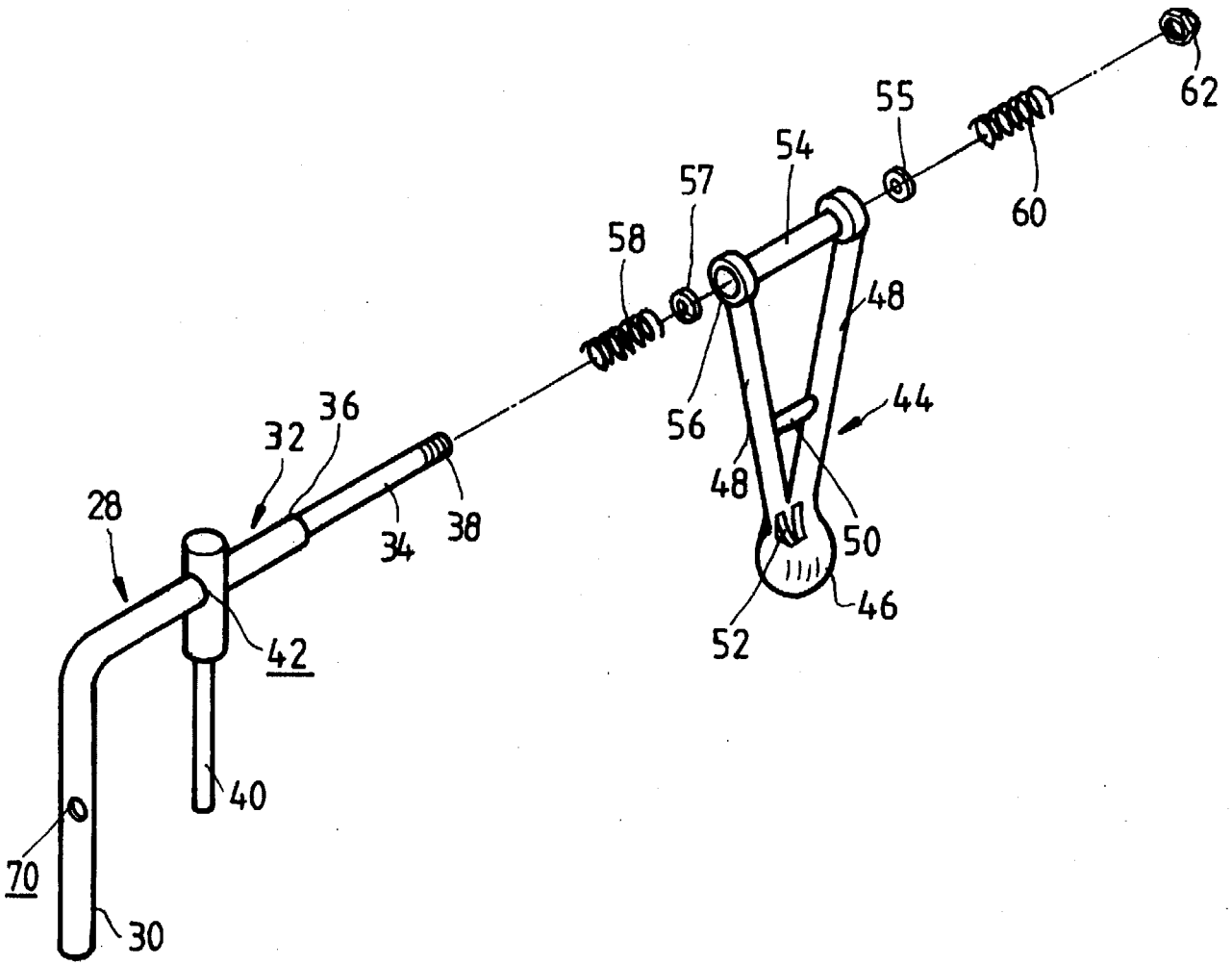
FIG. 3 is an exploded perspective view showing the dummy ball suspension assembly of the golf training device of the present invention.

A cantilever type support 28 preferably in the form of an L, see FIG. 3, comprises a first section 30 having a lower end movably receivable within the bore 22 of the primary column 18 and an opposite end extending out of the bore 22 of the primary column 18 a distance and a second section 32 extending transversely from the upper end of the first section 32 and having a free end section 34 of a reduced cross-sectional dimension so as to define a shoulder 36 between the second section 32 and the free end section 34. The insertion of the first section 30 into the bore 22 of the primary column 18 allows the second section 32 and the free end section 34 to reach out as a cantilever beam to which a dummy ball assembly 44 may be attached.

A threading 38 is provided on the free end of the free end section 34.

A secondary support bar 40 has a transverse through hole 42 formed thereon to allow the second section 32 of the support 28 to extend therethrough so as to have the secondary support bar 40 extending therefrom in a direction substantially parallel with the first section 30 of the support 28 and movably receivable within the bore 24 of the secondary column 20 to more securely hold the support 28 in position.

The dummy ball assembly 44 comprises a spherical member 46, serving as the dummy ball, and two suspension rods 48 having lower ends fixed to and extending from the spherical member 46 in a diverging manner to upper free ends thereof so as to define a V shape. A reinforcing bar 50 extends transversely and connects between the two suspension rods 48 to enhance the structural strength thereof.

A reinforcing rib 52 may be provided on each side of the connection of each of the rods 48 with the spherical member 46 to reinforce the connection between the rod 48 and the spherical member 46.

The dummy ball assembly 44 comprises a tubular member 54 connected to and straddling between the upper free ends of the suspension rods 48. The tubular member 54 comprises a central bore 56 slidably fit over the free end section 34 of the support 28 so as to slidably suspend the dummy ball 46 under the second section 32 of the support 28 and allow the relative movement of the dummy ball assembly 44 with respect to the support 28. To facilitate the relative movement, the tubular member 54 may comprise bearing means 55 and 57 received therein and spaced from each other to support a lower resistance engagement between the tubular member 54 and the free end section 34 of the support 28. The bearing means 55 and 57 may be of any known structure.

Biasing means, such as helical springs 58 and 60, is provided to absorb the component of an external force striking the dummy ball 46 along the direction of the second section 32. The first helical spring 58 is fit over the free end section 34 of the support 28 and located between the shoulder 36 and the upper free end of a first one of the suspension rods 48 that is adjacent to the shoulder 36, while the second spring 60 that is also fit over the free end section 34 of the support 28 is located between a nut 62 that engages the end threading 38 of the free end section 34 of the support 28 and a second one of the suspension rods 48 that is adjacent the end threading 38.

Preferably, the dummy ball assembly 44 is mounted to the free end section 34 of the support 28 so that a first distance exists between the shoulder 36 and the upper end of the first suspension rod 48 and a second distance exists between the nut 62 and the upper end of the second suspension rod 48. The first spring 58 has an un-loaded length substantially equal to the first distance and the second spring 60 has an un-loaded length substantially equal to the second distance so that when the dummy ball 46 is not hit, it is maintained in an un-loaded condition.

Figure 4:
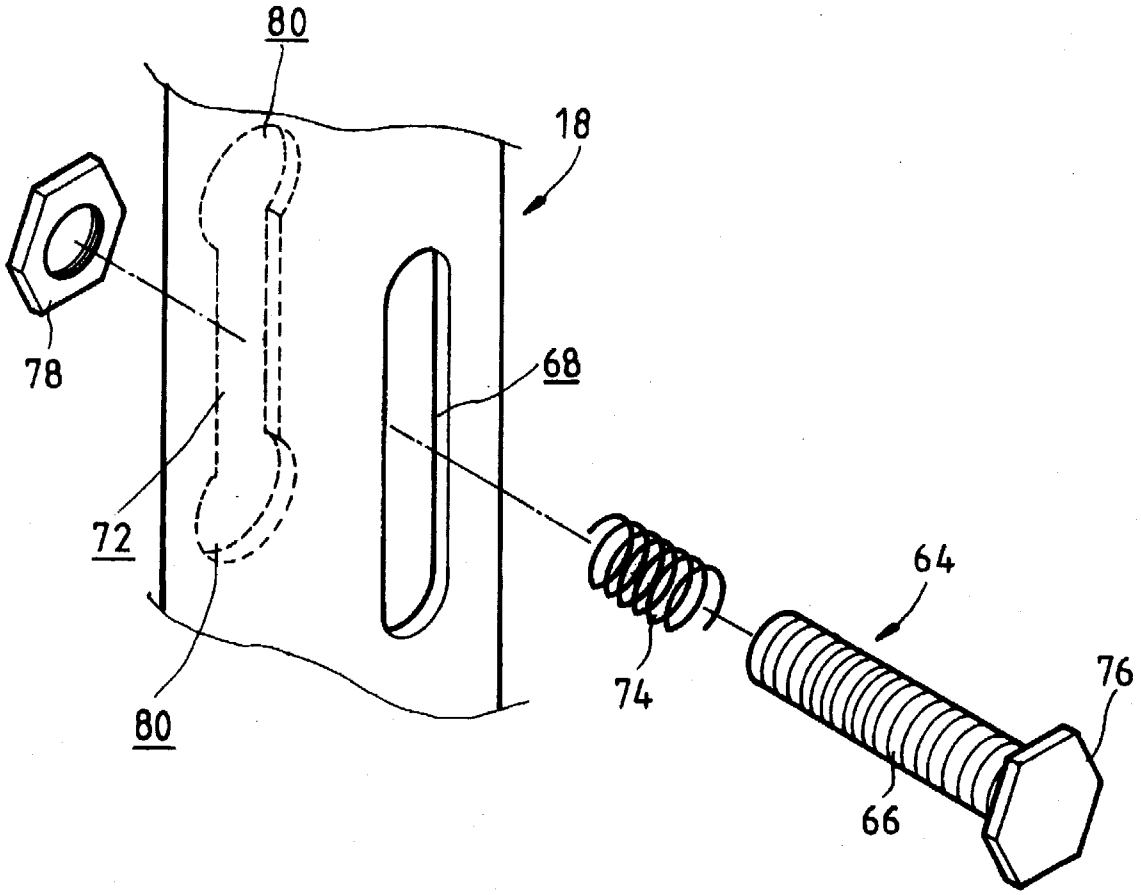
FIG. 4 is an enlarged view of a portion of the primary column showing the positioning slot formed thereon.

The primary column 18 may further comprise positioning means 64 (FIG. 4) comprising a bolt 66 extending in sequence through an elongated first slot 68 formed on the primary column 18, a transverse hole 70 (FIG. 3) formed on the first section 30 of the support 28 and a second, opposite slot 72 formed on the primary column 18. A biasing spring 74 is fit onto the bolt 66 and located between a head 76 of the bolt 66 and the first slot 68 of the primary column 18. A nut 78 engages on the bolt 66. The second slot 72 of the primary column 18 comprises an expanded hole 80 on an upper and a lower ends thereof. The expanded holes 80 are sized to receive the nut 78 therein. However, the second slot 72 has a width not sufficient to allow the nut 78 to pass therethrough, but allowing the bolt 66 to pass. The biasing force of the spring 74 biases the bolt 66 in such a direction to retain the nut 78 within one of the expanded holes 80 so as to position the first section 30 of the support 28 at a position corresponding to one of the expanded holes 80.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A golf training device comprising an anchoring base having a primary column extending upright therefrom and having an axially extending first bore, a support comprising a first section having a lower end movably received within the first bore of the primary column and an upper end extending a distance out of the first bore and a second section extending transversely from the upper end of the first section to define a cantilever configuration and a dummy ball assembly comprising a spherical member and two spaced suspension rods having lower ends connected to and extending from the spherical member in an inclined, diverging manner to upper ends that are spaced from each other with a tubular member connecting between the upper ends, the tubular member having a central bore to slidably fit onto the second section of the support so as to rotatably suspend the spherical member under the second section of the support and to allow relative moment of the dummy ball assembly with respect to the support, each of the suspension rods having biasing means associated therewith for counteracting a component of an external force applied to the spherical member along a direction parallel with the second section.

2. The golf training device as claimed in claim 1, wherein a transverse reinforcing bar is connected between the two suspension rods.

3. The golf training device as claimed in claim 1, wherein the tubular member of the dummy ball assembly that connects between the upper ends of the suspension rods comprises bearing means disposed therein to bear the relative moment of the dummy ball assembly with respect to the support.

4. The golf training device as claimed in claim 1, wherein biasing means comprises a first helical spring fit over the second section and located between the upper end of a first one of the suspension rods and a shoulder formed on the second section of the support and a second helical spring fit over the second section and located between the upper end of a second one of the suspension rods and an end fastener mounted on a free end of the second section of the support.

5. The golf training device as claimed in claim 4, wherein the second section of the support comprises a reduced free end section so as to define the shoulder therebetween.

6. The golf training device as claimed in claim 4, wherein the second section of the support comprises a threading formed on the free end thereof and the end fastener comprises a nut threadingly engaging the threading of the second section.

7. The golf training device as claimed in claim 4, wherein the dummy ball assembly is mounted to the second section of the support so that a first distance exists between the shoulder and the upper end of the first suspension rod which is substantially equal to an un-loaded length of the first helical spring and a second distance exists between the end fastener and the upper end of the second suspension rod which is substantially equal to an unloaded length of the second helical spring so that the dummy ball assembly is substantially not loaded on the support.

8. The golf training device as claimed in claim 1, wherein each of the suspension rods comprises a reinforcing rib formed on each of two opposite sides thereof to reinforce the connection of the suspension rod to the spherical member.

9. The golf training device as claimed in claim 1, wherein anchoring base comprises a secondary column extending upright therefrom to be substantially parallel with the primary column and having a second bore and wherein the support comprises a secondary support bar having an upper end connected to the support and a lower end movably receivable within the second bore of the secondary column.

10. The golf training device as claimed in claim 1, wherein the primary column comprises positioning means which is releasably engageable with the first section of the support so as to position the first section relative to the primary column to adjust the distance of the upper end of the first section of the support from the primary column.

11. The golf training device as claimed in claim 10, wherein the positioning means comprises a bolt extending through a transverse hole formed on the first section of the support with a first end of the bolt extending out of the primary column through an elongated slot formed on the primary column and a second end of the bolt extending in an opposite direction out of the primary column through a second slot formed on the primary column to engage a nut, the second slot having an expanded hole formed on an upper end and an lower end of the second slot and sized to receive the nut therein, a biasing spring is disposed between the bolt and the primary column to bias the nut into one of the upper and lower expanded holes so as to selectively position the first section of the support at a position corresponding to one of the upper and lower expanded holes.

* * * * *